US005415608A

United States Patent [19]

Bode et al.

[11] Patent Number: 5,415,608

[45] Date of Patent: May 16, 1995

[54] VERTICAL JUMP ENHANCEMENT SYSTEM

[75] Inventors: Barbara A. Bode, 201 Willowick Ave., Temple Terrace, Fla. 33617; Joe Cattadoris, Jr., Utica, N.Y.

[73] Assignee: Barbara A. Bode, Temple Terrace, Fla.

[21] Appl. No.: 45,567

[22] Filed: Apr. 9, 1993

[51] Int. Cl.[6] ..... A63B 21/04; A63B 23/04

[52] U.S. Cl. ..... 482/121; 482/129

[58] Field of Search ..... 482/121, 124, 129, 904, 482/121-130; 292/343

[56] References Cited

U.S. PATENT DOCUMENTS

| | | | |
|---|---|---|---|
| 775,989 | 11/1904 | Roberts | 482/129 |
| 4,073,490 | 2/1978 | Feather | 272/136 |
| 5,024,443 | 6/1991 | Bellagamba | 482/129 |
| 5,100,129 | 3/1992 | Porter et al. | 482/125 |
| 5,188,366 | 2/1993 | Dorotinsky et al. | 482/124 |

FOREIGN PATENT DOCUMENTS

| | | | |
|---|---|---|---|
| 0833418 | 2/1970 | Canada | 482/122 |
| 0358494 | 2/1906 | France | 482/24 |
| 2227949 | 8/1990 | United Kingdom | 482/129 |

OTHER PUBLICATIONS

Explosive Power, Sports Imports Incorporated, Columbus, Ohio Supercat, Powernetics, Riverside, Tex.

Plyometrics, Michael L. Voight, Peter Draovitch, Eccentric Muscle Training in Sports and Orthopedics by Mark Albert, 1991, NY: Churchill Livingstone, pp. 45-73.

Understanding Plyometrics-A Lesson in Muscle Structure, Bounding to the Top: the Complete Book on Plyometrics & Training for all Sports, 1984, pp. 1-3.

*Primary Examiner*—Richard J. Apley
*Assistant Examiner*—John Mulcahy
*Attorney, Agent, or Firm*—Howard & Howard

[57] ABSTRACT

The present invention relates to a plyometric training device that is simple in construction, inexpensive and easily portable. The plyometrics training device of the present invention includes a harness for attachment to a user and a pair of resilient cords attached to said harness to resist the vertical movement of a user as the user jumps vertically upwardly from a surface. In the preferred embodiment, the resilient cords have free ends that can be attached to a pair of ground anchors or a pair of door anchors or that can be stood upon by assistants to anchor the cords. In the later anchoring method, hand grips are provided that can be gripped by the assistants and the resilient cord is sufficiently long so that the cord is anchorable by passing underneath at least one foot of each of the assistants and gripped at the hand grips.

5 Claims, 1 Drawing Sheet

VERTICAL JUMP ENHANCEMENT SYSTEM

BACKGROUND OF THE INVENTION

The present invention relates to physical conditioning devices used to help improve vertical jumping ability and more specifically relates to plyometric training systems.

Plyometrics training is a training process which improves speed and jumping ability. It does so by heightening the excitability of the nervous system for improved reactive ability of the neuromuscular system. Plyometric exercises involve explosive movement such as jumping. It occurs naturally in activities such as hopping, skipping and jumping. Generally, this form of exercise is resistance training that involves the rapid stretching of muscles from an eccentric contraction to a concentric contraction to produce a forceful movement in a short period of time. These exercises train the eccentric aspect of muscle contraction in order to improve the relationship between maximum strength and explosive power. This explosive power is defined as the ability to recruit as many muscle fibers as possible and to maintain that explosion of muscle contraction over a short period of time. Weight training does not train this explosive power of muscle strength. Both weight training and plyometric training are necessary for overall athletic training.

There are plyometrics training systems presently available. One such system is called the Supercat which is a mechanical device having a pivotal arm which must be raised by the user when the user jumps vertically. Movement of the pivotal arm is controlled by controlled resistance to resist the user's vertical jump. One difficulty with this system is the expense. It is a fairly complex exercise mechanism which is expensive to manufacture. Another difficulty with the Supercat is that it is not easily portable. A similar plyometrics training unit is the Leaper which is very similar to the Supercat unit and has the same disadvantages.

Another example of plyometrics training systems is the Russian Leaper which consists of a surface with two rubberized elastic bands and a belt. The belt can be worn by the user and the user jumps vertically against the resistance of the rubberized bands. Although the Russian Leaper is believed to be less expensive to manufacture and purchase than the Supercat and the Leaper, the Russian Leaper is still not an inexpensive exercise system. Furthermore, it is not easily portable in that it requires a relatively large somewhat immobile base.

Another disadvantage of the above systems is that they do not readily adapt themselves for use just prior to an athletic event wherever the event is being held. It has been found by experts in this area that short intense plyometric jumping workouts can be used as a warmup before competition to raise the excitability of the nervous system. The above apparatus are difficult to use in this way because they are not portable.

SUMMARY OF THE INVENTION

The present invention provides an improved plyometric device that is portable, versatile, and inexpensive to manufacture.

In one embodiment, the plyometrics training device includes a harness for attachment to a user. The device includes a pair of resilient cords attached to the harness to resist the vertical movement of a user as the user jumps vertically upwardly from a surface. The cords have free ends with each end having hand grips. The hand grips are adapted to be gripped by assistants, with each resilient cord being sufficiently long so that the cord can be anchored to the surface by passing underneath at least one foot of each assistant and gripped at the hand grips. As should be appreciated, this system is inexpensive to manufacture and is easily transported. All it requires is coiling the cord with the harness.

In another embodiment, the anchoring means is a pair of knife-like members that can be inserted into the ground. The members are spaced apart and angled toward one another to resist being pulled out of the ground. The anchor has connecting means for interconnecting the pair of resilient cords to the anchoring means. In this way, the resilient cords can be anchored to the ground and resist the vertical movement of a user as the user jumps.

In a further embodiment, the pair of resilient cords are attached to a pair of anchoring means for anchoring the resilient cords to a door. Each of the anchoring means of this embodiment extend outwardly, and generally perpendicular to the door. In this way, each resilient cord can be mounted to an anchoring means a spaced distance from the door sufficient to permit a user to jump vertically without interference with the door. Each anchoring means includes a leg member having opposed ends with the resilient cord being anchored at one of the opposed ends. A foot member is pivotably mounted to the opposite end of the leg member with the foot member being adapted to be mounted under the door. An adjusting means is operatively mounted between the leg member and the foot member. The adjusting means is adapted to pivot the leg member and foot member with respect to one another to wedge the anchoring means under the door. When properly anchored, the anchoring means has three points of contact, one on the underside of the end to which the cord is attached, one on the underside of the foot and the third on the top of the anchor.

DETAILED DESCRIPTION OF THE INVENTION

Figure 1:
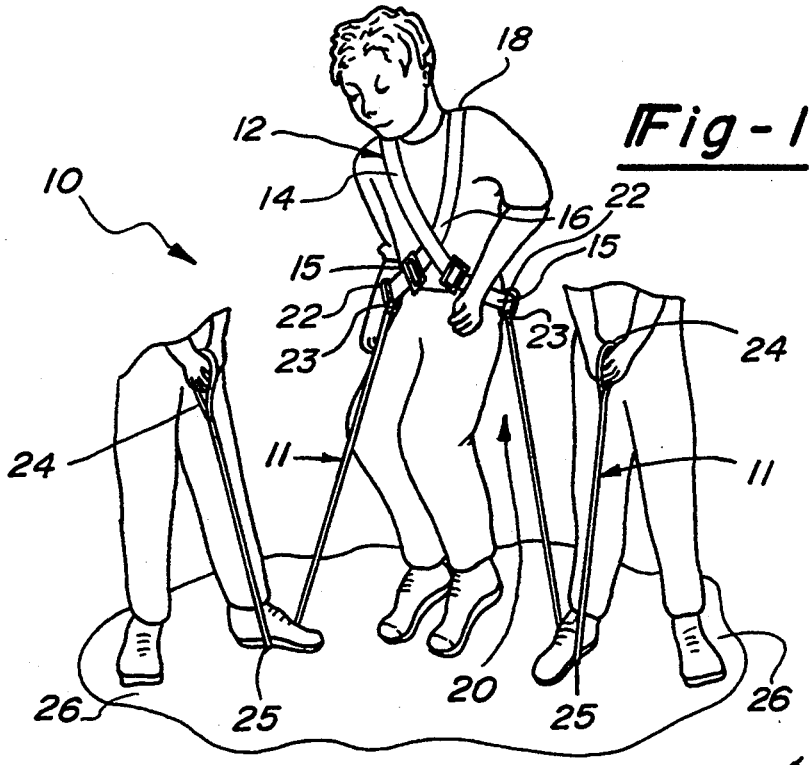
FIG. 1 is a perspective view of the plyometric device of the present invention.

With reference to FIG. 1, a first embodiment of the plyometrics device of the present invention is shown generally at 10. The plyometric device 10 broadly includes an attaching means 12 for attachment to a user and resilient cords 11 to resist the vertical movement of a user as the user jumps vertically upwardly from the ground and anchoring means for anchoring the cords.

The attaching means 12 is preferably a harness adapted to be worn by the user over the user's shoulders. The harness has cross straps 14 that are maintained in their proper position by velcro 16. The harness is put over the chest, shoulder, and back so that the straps 14 cross over front and back. In the preferred embodiment, the harness is made of nylon and includes heavy-duty quick release polyvinyl buckles 15. For comfort, padding 18 is provided under the straps 14. The harness also includes connecting means 20 for connecting the resilient cords to the harness 12. In the preferred embodiment the connecting means are metal loops 22 to which fastening hooks 23 can be fastened.

As can be seen from FIG. 1, there are two resilient cords 11 which are mounted through hooks 23 to harness 12. The cords 11 have hand grips 24 at each of the free ends of the resilient cords 11. The hand grips 24 are adapted to be gripped by assistants that assist the user by anchoring the resilient cords 11 to the surface 26. As can also be seen, the resilient cord 11 is sufficiently long so that the cord 11 can pass underneath at least one foot of each of the assistants and then each of the assistants can grip one of the hand grips 24. In the preferred embodiment, each of the resilient cords 11 are made of surgical tubing and are 6 feet to 8 feet in length from their attached end to the end of the hand grip 24. The cords 11 also include about 4" of reinforced vinyl tubing at 25 for protection of the cords 11 when stepped upon. The amount of resistance is determined by the diameter of the cords and the number of cords used simultaneously. Cord diameters of $\frac{1}{4}$ inch, $\frac{3}{8}$ inch, and $\frac{1}{2}$ inch are preferred.

As discussed above, the illustrated plyometrics device 10 is inexpensive to manufacture and is very lightweight, therefore very portable.

Figure 2:
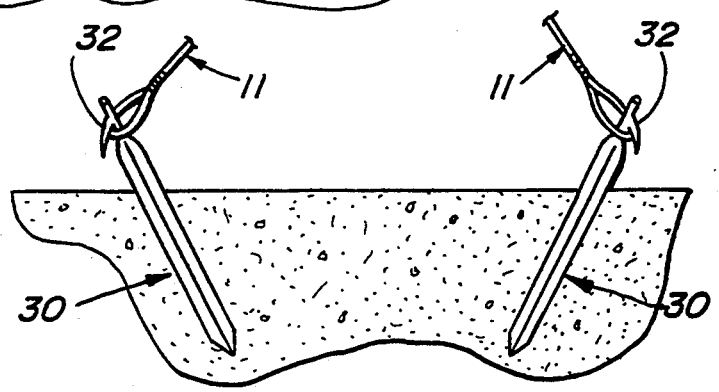
FIG. 2 is a perspective view of a second embodiment of the present invention.

With reference to FIG. 2, a second embodiment of the present invention is illustrated. In this embodiment, a pair of resilient cords 11 are mounted to a harness 12 as in the first embodiment. The free ends 28 of the cords 11 are secured to a pair of anchoring devices 30 and 31. The anchoring devices have a connecting attachment 32 for receipt of the resilient cords 11. It should be understood that other means could be employed for mounting the resilient cords 11 to the anchoring device 30.

The anchoring devices are knife-like and adapted to be inserted into the ground at a distance of about 24 to 30 inches and to be angled inwardly toward one another. In the preferred embodiment, the knife is fifteen (15) inches in length and made of metal. As should also be appreciated by those of ordinary skill in the art, the anchoring device 30 obviates the need for assistants and still provides a readily usable, inexpensive, and portable plyometric device. In this embodiment, the cords are preferably 2 feet to 4 feet in length and can be adjusted lengthwise if necessary.

It should be appreciated that the cords 11 could be releasably fastened to anchor 30 or fastened permanently to anchor 30.

Figure 3:
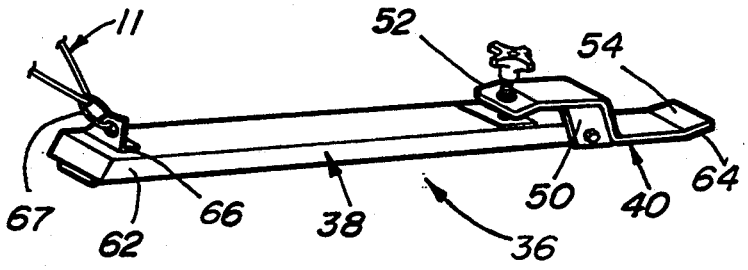
FIG. 3 is a perspective view of a third embodiment of the present invention.

Referring now to FIG. 3, a still further embodiment of the present invention is illustrated. An anchoring device 36 is illustrated that permits the resilient cord 11 to be anchored to a door. In the preferred embodiment, there are two of these anchoring devices and they are spaced apart between 24 to 30 inches. It should be understood that the resilient cord 11 has to be anchored a spaced distance from each door so that the user can freely jump without interfering with the door. In order to get the resilient cords 11 away from the door, the anchor 36 has to be sufficiently long, but sufficiently rigid to space cords 11 from the door and to properly anchor cords 11. However, in providing the needed rigidity and simultaneously maintaining portability of the device 10, a lightweight but strong device must be used.

Figure 4:
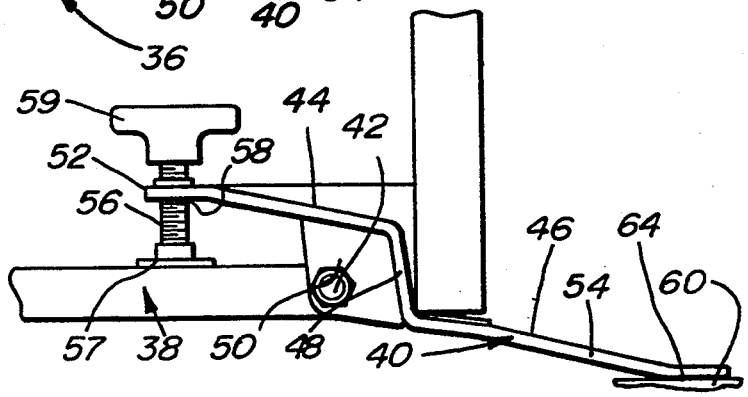
FIG. 4 is a side view of the third embodiment.

To accomplish the dual purposes required, the anchors 36 have a leg member 38 pivotally connected to a foot member 40. In the preferred embodiment, the leg member 38 is a square tube and the foot 40 is made of flat plate. The members 38 and 40 are pivotally coupled by a pivot axis 42. In the disclosed embodiment, the pivot axis is a nut and bolt that are received within an aperture in the foot 40 and the leg 38. The foot 40 has a top portion 44, a bottom portion 46 and a connecting intermediate portion 48. In the disclosed embodiment, the intermediate portion has side members 50 for added support. These side supports 50 are welded to the intermediate 48 and top portion 44. Both ends 52 and 54 of the foot 40 are slightly bent with respect to the top and bottom portions respectively. As can be seen, by bending the ends slightly, the end 52 is generally parallel to the leg member 38 and the end 54 is generally parallel to the surface 60 when the support is properly wedged under a door. See FIG. 4.

A screw or bolt 56 is threaded into an internally threaded aperture 58 in end 52. This bolt 56 is generally perpendicular to the top surface of leg member 38. The end of the bolt 56 engages the top of leg member 38 so that as bolt 56 is threaded into the end 52, the leg member 38 and the foot member 40 pivot with respect to one another. A base 57 can be used to facilitate the engagement of bolt 56 with leg 38. In this way, the opposed ends 62 and 64 engage the surface 60 and the bottom portion 46 engages the bottom of the door providing a strong three point contact area- The anchor 36 is actually wedged under the door. To facilitate threading the bolt 56, a handle 59 is provided in the preferred embodiment.

The opposed end 62 has a hold down eye 66 for mounting a resilient cord 11. The cord preferably has a loop 67 with closable openings for connecting to eye 66. In the preferred embodiment, the eye 66 is approximately 24 inches from the door providing a 24 inch projection from the door. The 24 inch projection provides sufficient space from the door to prevent interference with the door. In this embodiment, the cords 11 are preferably 2 feet to 4 feet in length. Again, the cord length can be adjusted.

Although the present invention has been described in detail with reference only to the presently preferred embodiments, it will be appreciated by those of ordinary skill in the art that various modifications can be made without departing from the invention. Accordingly, the invention is to be limited only by the following claims.

What is claimed is:

1. A plyometrics training device comprising:

an attaching means for attachment to the upper torso of a user;

a pair of resilient cords attached to said attachment means to resist the vertical movement of a user as the user jumps vertically upwardly from a surface;

a pair of anchoring means for anchoring the resilient cord to a door adjacent the surface, said anchoring means being adapted to extend outwardly, generally perpendicular to the door, so that each of said resilient cords is mountable to a respective one of said anchoring means a spaced distance from the door sufficient to permit a user to jump vertically without interference with the door;

each of said anchoring means including an articulated leg member having opposed ends with a respective one of said resilient cords being anchored at one of said opposed ends and the opposite end being adapted to be received beneath the door, said articulated leg including means for wedging said anchoring means beneath the door.

2. The plyometrics training device of claim 1, wherein said anchoring means includes a leg member having opposed ends with said resilient cord being anchored at one of said opposed ends;

a foot member pivotably mounted to the opposite end of said leg member, said foot member being adapted to be received beneath the door;

an adjusting means operatively mounted between said leg member and said foot member, said adjusting means being adapted to pivot said leg member and foot member with respect to one another to wedge said anchoring means under said door.

3. The plyometrics training device of claim 2, wherein said foot member bas a top portion through which said adjusting means is threadably mounted, a bottom portion adapted to be mounted under a door, and an intermediate member that is pivotably mounted to said leg member.

4. The plyometrics training device of claim 2, wherein said leg member is twenty-four inches in length.

5. The plyometrics training device of claim 2, wherein said adjusting means is a bolt, said foot member having a threaded bore for threadably receiving said bolt said bolt being adapted to engage said leg members to pivot said foot and leg member to wedge said anchoring means beneath said door.

* * * * *